US008074679B2

(12) United States Patent
Jensen et al.

(10) Patent No.: US 8,074,679 B2
(45) Date of Patent: Dec. 13, 2011

(54) Y-TYPE FLUID END WITH REPLACEABLE SUCTION MODULE

(75) Inventors: Ernest Jerome Jensen, Tulsa, OK (US); Anthony Waylan McLain, Broken Arrow, OK (US)

(73) Assignee: Gardner Denver, Inc., Quincy, IL (US)

( * ) Notice: Subject to any disclaimer, the term of this patent is extended or adjusted under 35 U.S.C. 154(b) by 387 days.

(21) Appl. No.: 11/614,405

(22) Filed: Dec. 21, 2006

(65) Prior Publication Data

US 2008/0152523 A1 Jun. 26, 2008

(51) Int. Cl.
*F16K 21/04* (2006.01)

(52) U.S. Cl. ..... 137/512; 417/454; 417/571

(58) Field of Classification Search ..... 137/512; 417/559, 567, 566, 571, 454, 568
See application file for complete search history.

(56) References Cited

U.S. PATENT DOCUMENTS

| | | | | |
|---|---|---|---|---|
| 144,844 | A | 11/1873 | Gould et al. | |
| 185,578 | A | 12/1876 | Rankin | |
| 1,428,928 | A | 9/1922 | Whaley | |
| 1,705,800 | A | 3/1929 | Akeyson | |
| 2,011,547 | A | 8/1935 | Campbell | |
| 2,078,374 | A | 4/1937 | Shepherd et al. | |
| 2,351,304 | A * | 6/1944 | Tabb | 417/435 |
| 2,854,021 | A | 9/1958 | Baldwin, Jr. et al. | |
| 2,909,192 | A | 10/1959 | Dobrick | |
| 3,098,642 | A | 7/1963 | Kucmerosky et al. | |
| 3,319,879 | A * | 5/1967 | Brown | 417/571 |
| 3,356,036 | A * | 12/1967 | Repp | 417/559 |
| 3,373,695 | A | 3/1968 | Yohpe | |
| 3,427,988 | A | 2/1969 | Redman et al. | |
| 3,800,824 | A | 4/1974 | Medina | |
| 3,870,439 | A | 3/1975 | Stachowiak et al. | |
| 3,882,883 | A | 5/1975 | Droegemueller | |
| 4,277,229 | A | 7/1981 | Pacht | |
| 4,368,756 | A | 1/1983 | Carlson | |
| 4,432,386 | A | 2/1984 | Pacht | |
| 4,508,133 | A | 4/1985 | Hamid | |
| 4,520,837 | A | 6/1985 | Cole et al. | |
| 4,614,661 | A | 9/1986 | White et al. | |
| 4,766,927 | A | 8/1988 | Conatser | |
| 4,771,801 | A | 9/1988 | Crump et al. | |
| 4,878,815 | A | 11/1989 | Stachowiak | |

(Continued)

FOREIGN PATENT DOCUMENTS

BE 522601 9/1953

(Continued)

OTHER PUBLICATIONS

Abstract for CN 1566632A.

(Continued)

*Primary Examiner* — John Rivell
*Assistant Examiner* — Macade Brown
(74) *Attorney, Agent, or Firm* — Husch Blackwell LLP; James B. Conte

(57) ABSTRACT

A fluid end assembly for a high pressure pump receives a fluid from a fluid supply manifold and supplies the fluid to an outlet manifold. The assembly includes a housing with a removable suction module. The housing has a plunger bore to receive a reciprocating plunger, a suction passage intersects said plunger bore, and a discharge passage intersects both said plunger bore and said suction passage. The removable suction module has an inlet passage.

8 Claims, 5 Drawing Sheets

U.S. PATENT DOCUMENTS

| | | | |
|---|---|---|---|
| 5,052,435 | A | 10/1991 | Crudup et al. |
| 5,145,340 | A | 9/1992 | Allard |
| 5,171,136 | A | 12/1992 | Pacht |
| 5,226,445 | A | 7/1993 | Surjaatmadja |
| 5,253,987 | A | 10/1993 | Harrison |
| 5,362,215 | A | 11/1994 | King |
| 5,636,975 | A | 6/1997 | Tiffany et al. |
| 5,947,387 | A | 9/1999 | Zink et al. |
| 6,039,073 | A | 3/2000 | Messick et al. |
| 6,382,940 | B1 | 5/2002 | Blume |
| 6,435,475 | B1 | 8/2002 | Blume |
| 6,544,012 | B1 | 4/2003 | Blume |
| 6,623,259 | B1 | 9/2003 | Blume |
| 6,910,871 | B1 | 6/2005 | Blume |
| 7,172,175 | B2 | 2/2007 | Vicars |
| 7,335,002 | B2 | 2/2008 | Vicars |
| 2003/0133813 | A1 * | 7/2003 | Bennitt et al. ..... 417/403 |
| 2004/0234404 | A1 * | 11/2004 | Vicars ..... 417/571 |

FOREIGN PATENT DOCUMENTS

| | | |
|---|---|---|
| CA | 1113346 | 12/1981 |
| CH | 557493 | 9/1972 |
| CN | 1566632 A | 1/2005 |
| FR | 522.661 | 8/1921 |
| JP | 58-113672 | 7/1983 |

OTHER PUBLICATIONS

Examination Report for companion CN 15666332A.
Cross Section of an L Type Fluid end of a piston pump which has a suction module and a discharge module. The fluid end and pump are prior art to Applicant's invention, 2 pgs.

* cited by examiner

Y-TYPE FLUID END WITH REPLACEABLE SUCTION MODULE

FIELD OF THE INVENTION

The present disclosure generally relates to high-pressure positive displacement pumps and in particular, pumps having a power end driving a reciprocating plunger within a fluid end.

BACKGROUND OF THE INVENTION

Oil, natural gas, and other hydrocarbons are obtained by drilling wells into the earth and forcing them to the surface for collection. It is often difficult to produce hydrocarbons in an economic manner from low permeability reservoir rocks. Production rates are often boosted by resorting to hydraulic fracturing, a technique that increases rock permeability by opening channels through which hydrocarbons can flow to recovery wells. During hydraulic fracturing, a fluid is pumped into the earth under high pressure where it enters a reservoir rock and cracks or fractures it. Proppants are carried in a suspension by the pumped fluid into the fractures. When the pressure is released, the fractures partially close on the proppants, leaving channels for oil and gas to flow. Specialized pumps are used to develop the pressures necessary to complete a hydraulic fracturing procedure or "frac job."

Specialized pumps are also used in other drilling pump applications. For instance, during drilling of the well hole into the earth, specialized pumps are used to flush out the hole. Flush out is important to remove debris, such as rock chips ground out by the drill bit during drilling.

These specialized pumps are usually provided with fluid ends having reciprocating plungers or pistons that place fluids under pressure and valves that control fluid flow to and from the plungers. The body of a fluid end can be a metal forging of steel, having a "Y-type" configuration.

Y-type fluid ends have been developed in an effort to reduce the number of failures of fluid ends. It is known, Y-type fluid ends reduce concentrated stresses in the body of a fluid end by increasing the angles at which bores within the body intersect one-another above 90 degrees to about 120 degrees. A typical Y-type fluid end is disclosed in U.S. Patent Application Publication No. US 2004/0234404, now abandoned, which is incorporated herein by reference.

Y-type fluid ends require periodic replacement due to the loads placed on the portions of the end such as the suction deck. The valves also have to be frequently replaced.

SUMMARY OF THE INVENTION

One aspect of the invention provides a fluid end assembly having a Y-type configuration with an easily accessible suction valve and discharge valve that are capable of replacement without disassembly of piping connected to the pump.

Another aspect of our invention provides a fluid end assembly with a removable and replaceable suction module. The suction module is removably attached to a first section of the fluid end. The first section to which the suction module is attached, has a discharge passage, pumping chamber, plunger bore, and a portion of the suction passage.

Another aspect of the invention provides a fluid end assembly that features suction and discharge valves that have valve seats and pistons of the same size so that they are interchangeable.

Briefly, the fluid end assembly of the present disclosure receives a fluid from a fluid supply manifold and supplied the fluid to an outlet manifold. The assembly has a first section. A plunger bore extends into the first section. The plunger bore is oriented along a first center line. The plunger bore is configured for receiving a reciprocating plunger.

A discharge passage in the first section intersects the plunger bore. The discharge passage is oriented along a second center line. In the first section, a suction passage intersects the plunger bore. The suction passage is oriented along a third centerline. The center lines intersect to form a "Y" configuration.

A suction module forms a second section of the assembly. The suction module has an inlet which opens into a suction port. The port intersects a portion of the suction passage in the module. The suction port is oriented along a fourth center line. The fourth centerline is coplanar and transverse to said second centerline. The suction module is removably attached to the first section of the assembly.

The foregoing and other features and advantages of the present invention will become readily apparent upon further review of the following detailed description of the described embodiment and the accompanying drawings.

BRIEF DESCRIPTION OF THE DRAWINGS

FIG. 5 shows the suction module coupled to the first section by way of studs and nuts as an alternative to bolts;

DETAILED DESCRIPTION

Figure 1:
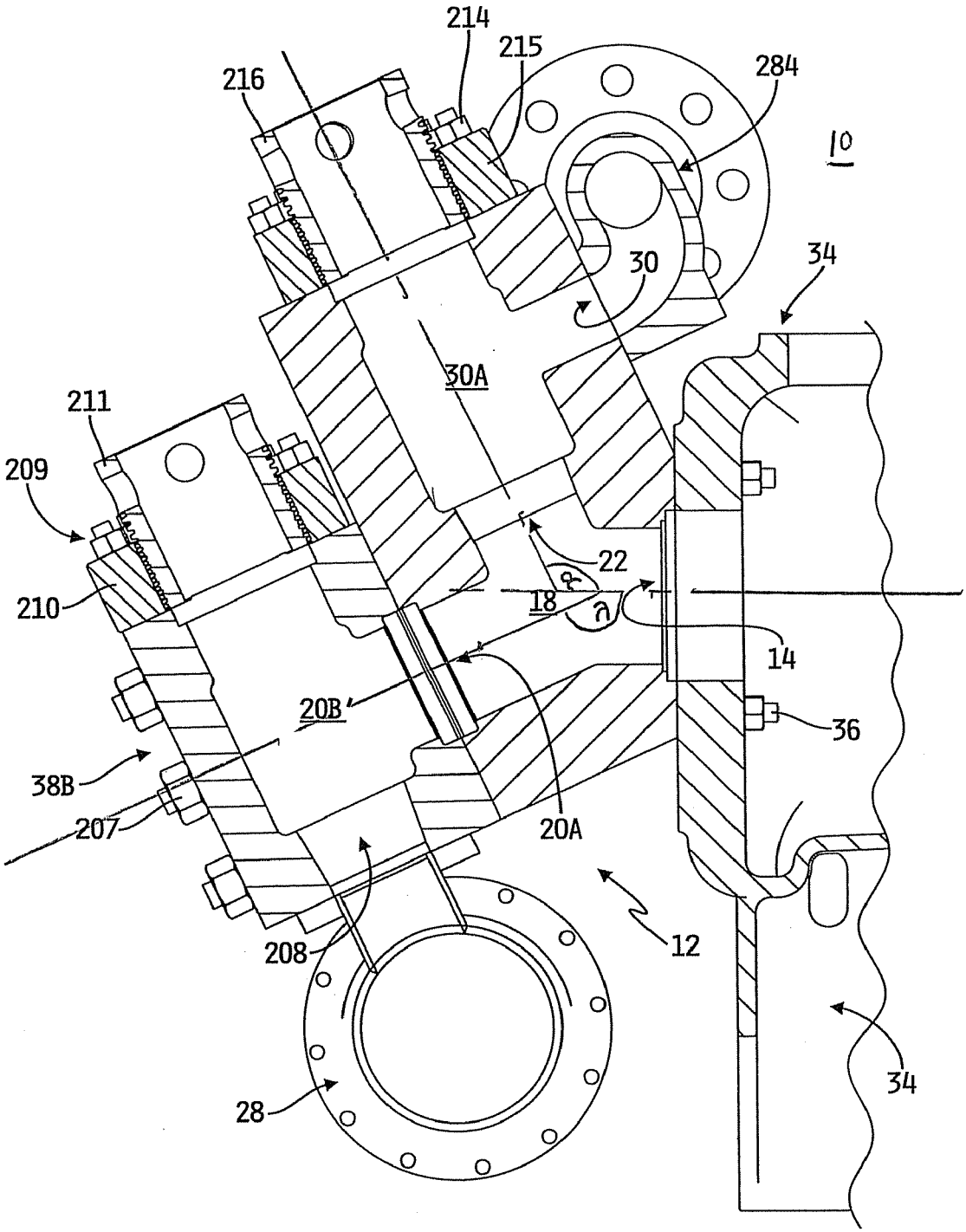
FIG. 1 is a stripped down cross-sectional view of a fluid end, exclusive of internal valve components, the assembly includes a removable suction module.
Figure 2:
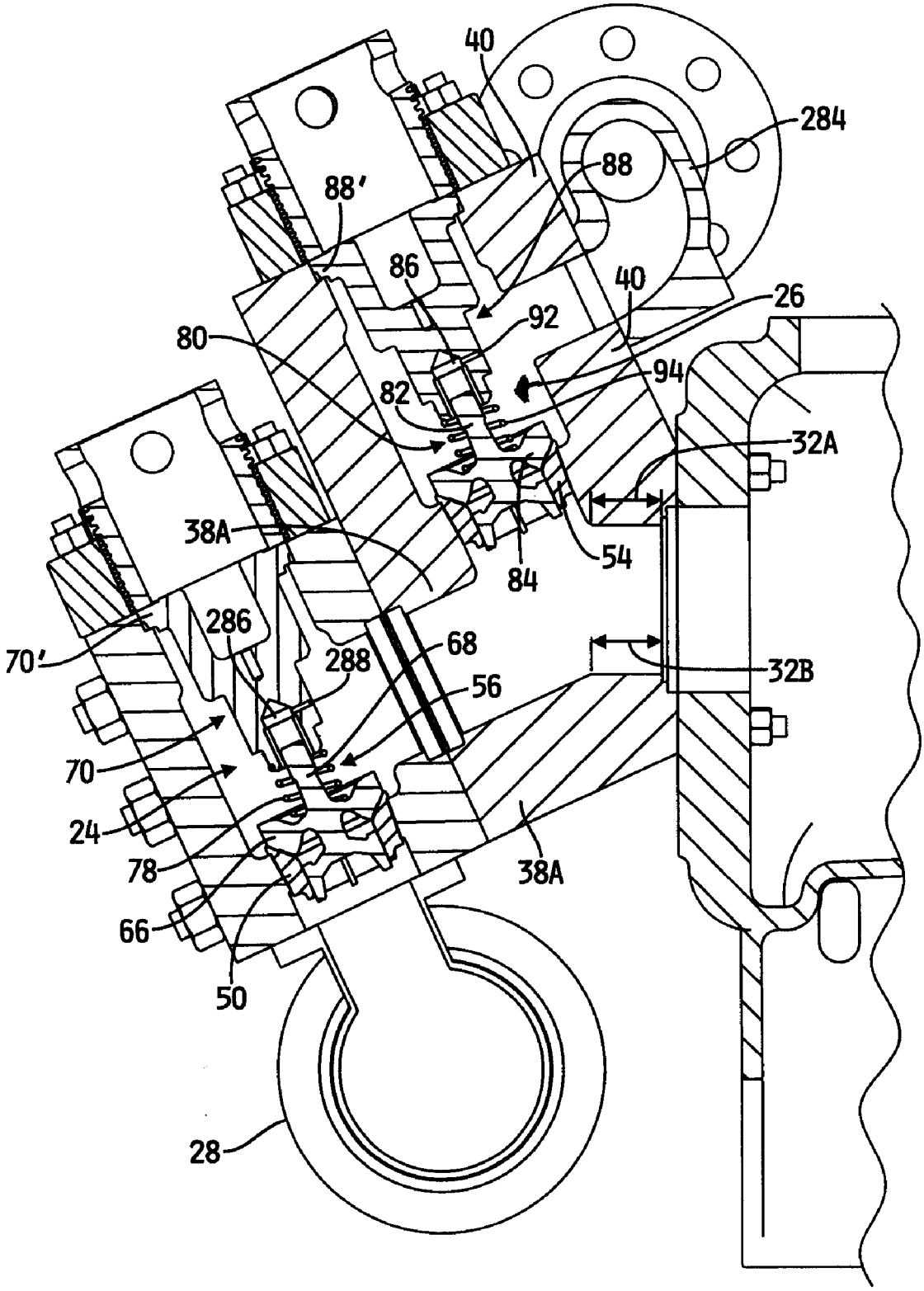
FIG. 2 is a stripped down cross-sectional view of the fluid end shown in FIG. 1, inclusive of internal valve components.
Figure 3:
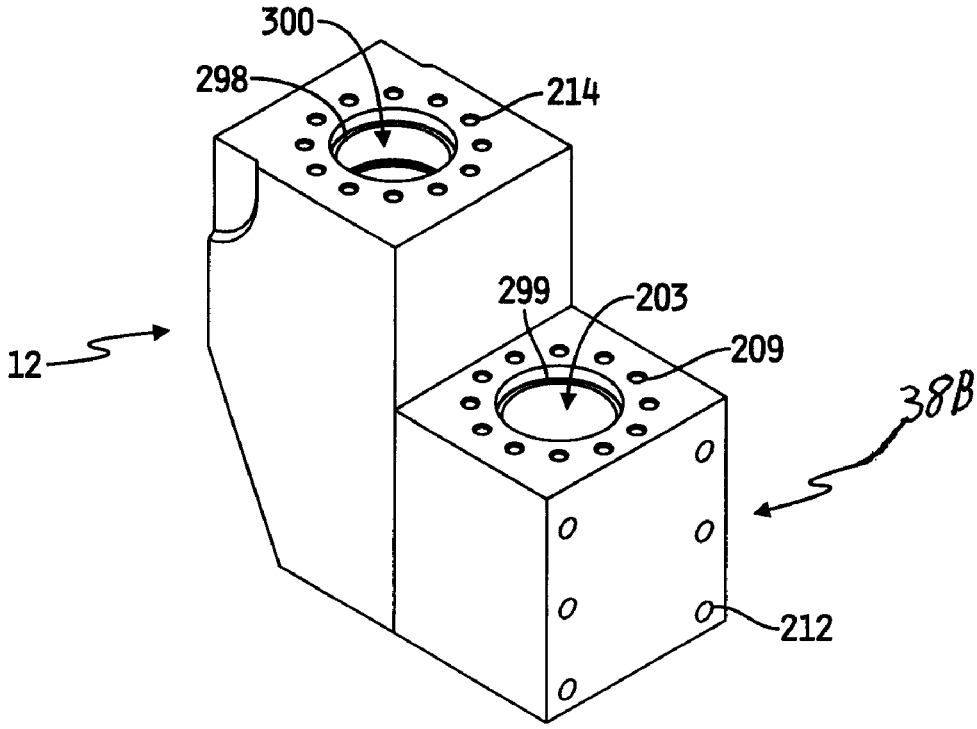
FIG. 3 is a side perspective view of the fluid block of FIG. 2; the block shows the suction module aligned with, but uncoupled to, the block first section.

Referring now to FIGS. 1 and 2, a fluid end assembly in accordance with the present invention is shown at 10. Fluid end assembly 10 has a housing, body or block formed by portions 32, 40, 38*a*, 38*b*. Portions 32, 40 and 38*a* form an integral first section 12 of the body. The first section can be made from a steel forging. Portion 38*b* forms a second portion removably attached to the first portion.

As can be seen from the figures, the first section is a monobloc seamless construction. The second section, as also can be seen from the drawings, is a monobloc seamless construction.

Portion 32 of the housing forms plunger section 32. Plunger section 32 has a bore 14, within which a plunger (not shown) reciprocates. Plunger bore 14 is provided within pump housing portion 32 At one end, plunger bore 14 terminates in a pumping chamber 18.

Housing portion 40 forms discharge section 40. A discharge passage 22 is formed in discharge section 40. Discharge passage 22 intersects plunger bore 14.

Housing portion 38*a* forms section 38*a* of the suction section formed by sections 38*a*, 38*b*. Portion 38*a* has portion 20*a* of a suction passage.

Housing portion 38*b* forms section 38*b* of the suction section. The suction section 38*b* can also be considered a suction module. Portion 38*b* has portion 20*b* of the suction passage 20*a*, 20*b*. Suction passage 20*a*, 20*b* intersects plunger bore 14.

The resulting Y-shaped configuration offered by the intersections of plunger bore 14 suction passage 20*a*, 20*b*, and discharge passage 22 reduces stresses within pump housing 12, 38*b* during use and minimizes the likelihood of the fluid end assembly failing over time.

Discharge passage 22 is formed in part by a counter bore 22*a* having a reduced diameter. Counter bore 22*a* extends from said plunger chamber 18 to discharge deck 52. Discharge deck 52 slopes at an angle of approximately 30°. A discharge port 30 in the discharge section 40 is in fluid communication with discharge passage 22 and in fluid communication with fluid discharge manifold 284. Fluid discharge manifold 284 may be connected to one or more conduits (not shown) to carry pressurized fluid from the discharge port 30 to perform work.

The plunger section 32 is of reduced length. The length at the discharge side is a length 32*a*. The length at the suction side is a length 32*b*. The plunger section 32 is adapted for attachment to the power end 34 of a high-pressure pump by a plurality of rods 36.

Figure 4:
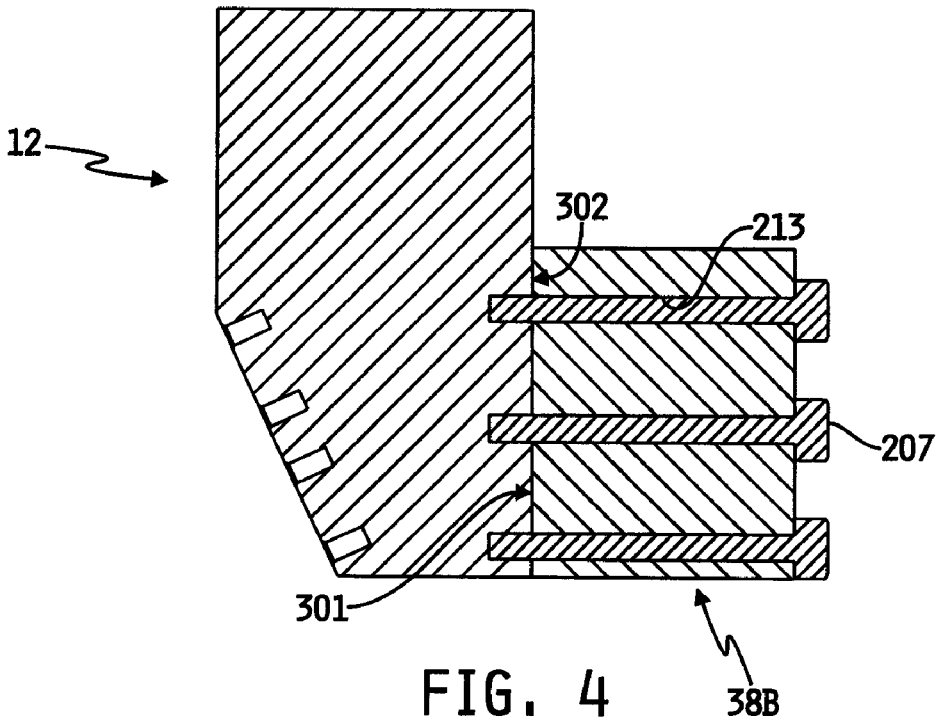
FIG. 4 is a cross section view of the block shown in FIG. 3 showing the suction module coupled to the first section with bolts.
Figure 5:
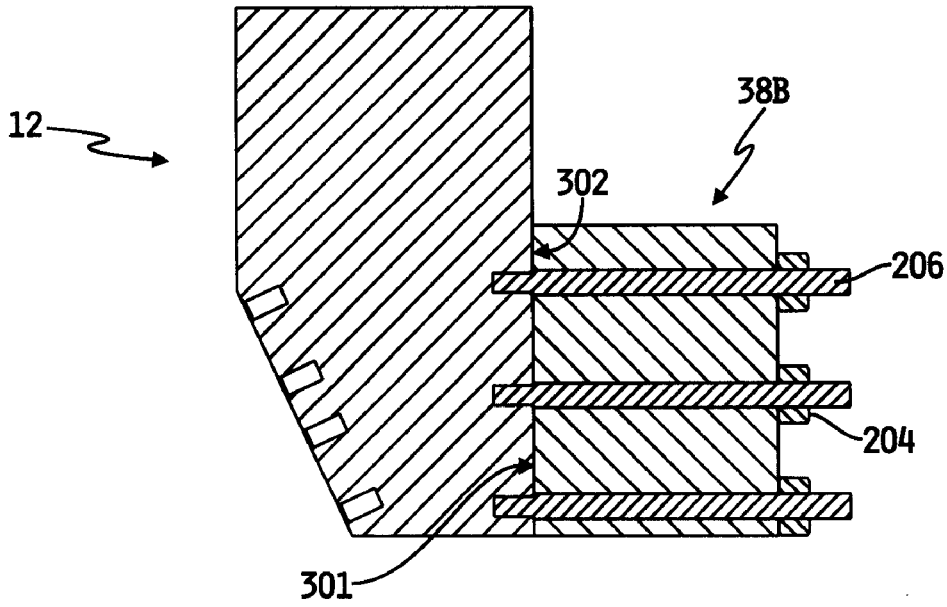
FIG. 5 is a cross sectional view of a block similar to that shown in FIG. 3.

Suction module 38*b* contains a suction port 208 in fluid communication with suction passage 20*b*. Suction port 208 and suction passage 20*b* intersect to form suction valve chamber 20*b*'. Inlet 290 forms an opening into suction port 208. Counter bore 290*a* forms a portion of the suction port 208 having a reduced diameter. Counter bore 290*a* extends from said inlet 290 to suction deck 48. The suction deck 48 forms a 90 degree ledge. A 90 degree ledge allows for interchangeability with many existing valve seats. Although not shown the suction deck could be configured to slope outwardly at an angle of approximately 30 degrees A fluid supply manifold 28 is located at inlet 290. As shown in FIG. 5, fasteners 204 (nuts) engage threaded rods or studs 206 to attach the suction module 38*b* to suction section 38*a*. It should be apparent that other types of fasteners, such as bolts 207, shown in FIG. 4 can engage pump housing portion 38*a* to suction module 38*b*, without departing from the spirit of the present invention. When bolts are used, the holes 213 in suction section 38*a* are threaded to receive a threaded end of bolt 207.

Figure 6:
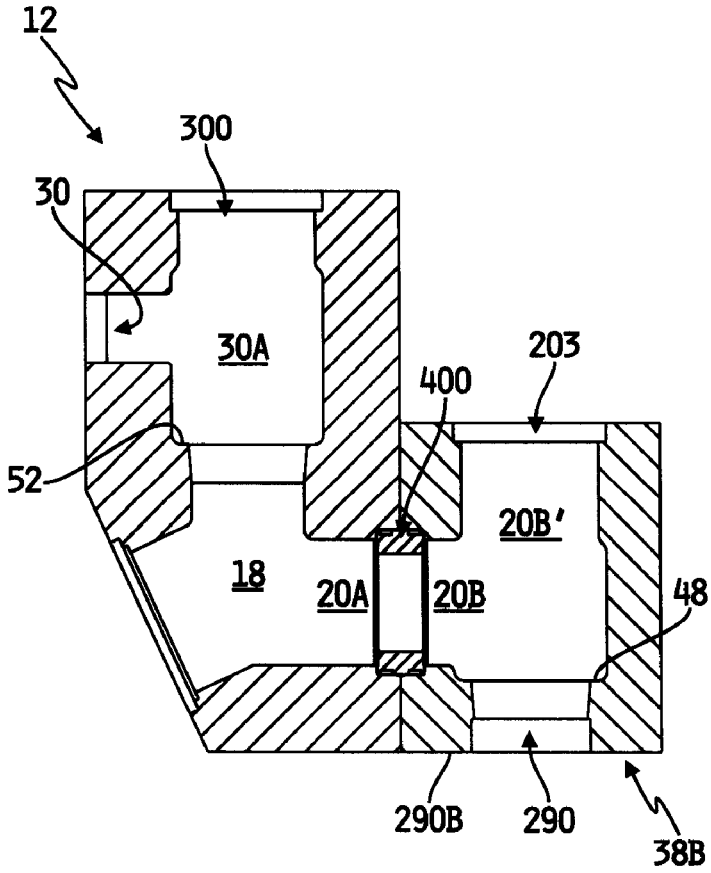
FIG. 6 is a cross sectional view of the block shown in FIG. 3 showing a sealing ring sealing the suction module to the first section.

The fasteners 204, 206 or 207 join face 301 of module 38*b* to a face 302 of suction section 38*a*. The faces 301, 302 are joined to align suction passage section 20*b* with suction passage section 20*a*. To seal the faces 301, 302 and suction passage sections 20*a*, 20*b* to one another, alternative types of seals can be used. In FIG. 6, a ring seal 400 is used. Ring seal 400 prevents leakage between the faces and passages.

Figure 7A:
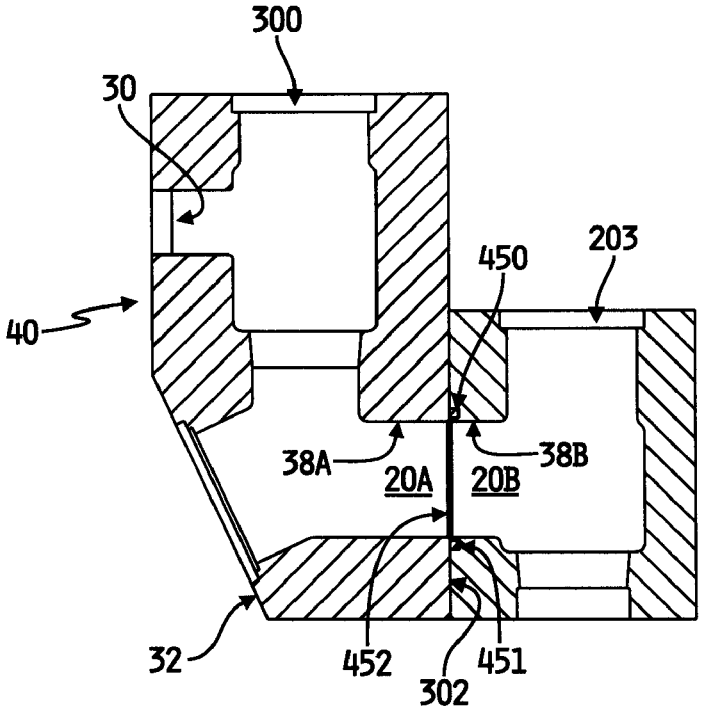
FIGS. 7*a*-7*b* are cross section views of the block shown in FIG. 3 utilizing face seals as an alternative to a ring seal.
Figure 7B:
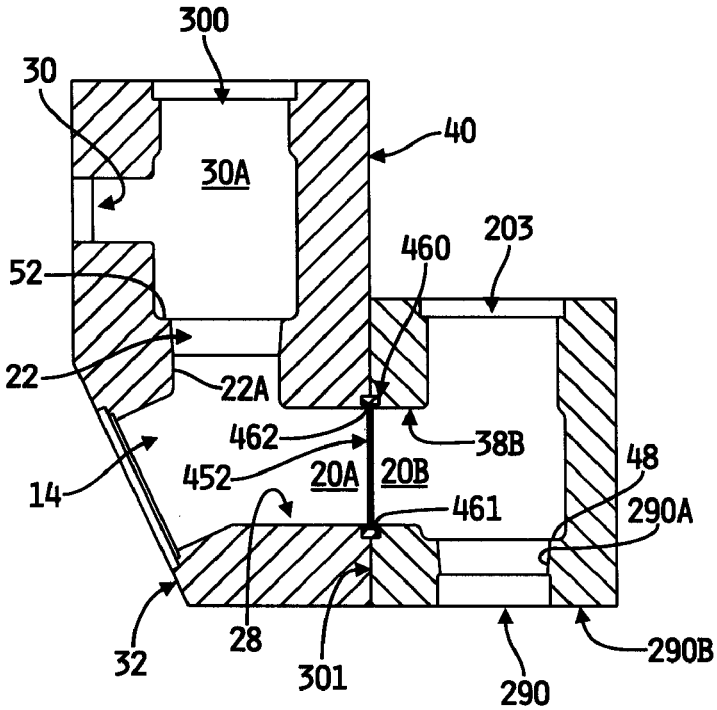

In FIGS. 7*a*-7*b* face seals, such as o-ring seals, are shown. In FIG. 7*a*, a face seal 450 is disposed in a groove 451. The groove borders opening 452 of suction passage section 20*b*. The seal is disposed in the groove. FIG. 7*b* shows an alternative face seal arrangement. In FIG. 7*b* a seal 460 is disposed in cooperating grooves 461, 462. The cooperating groove 461, 462 each receive a portion of seal 460. The seal 460 and groove portions 461, 462 border opening 452 to prevent water leakage.

Suction valve 24 is within suction module 38*b* and interfaces fluid supply manifold 28 with suction passage 20*a*, 20*b*. The valve 24 includes valve seat 50 and a piston 56 configured to interface with valve seat 50. Piston 56 has a head 66 for engaging valve seat 50 and a stem 68 extending from the head 66. A valve guide 70, has a socket 286 that slidably receives stem 68. At least one aperture 288 traverses suction valve guide 70 and intersect socket 286 to provide pressure relief to socket 286. A compressed spring 78 is positioned between, and exerts opposing forces upon, valve guide 70 and the suction valve head 66 so as to normally retain head 66 in flush engagement with valve seat 50 thus closing suction valve 24. The forces imparted by the valve seat 50 to the suction module 38*b* would be more evenly distributed by the use of a 30 degree angular slope of the suction deck 48. This would reduce the likelihood that fatigue-induced cracks will form in suction module 38*b*. Valve guide 70 has a suction valve cover portion 70' formed integrally from annular flange 70' of the suction valve guide 70. The cover portion 70' helps retain guide 70 in module 38*b*. The valve guide 70 is retained in the module 38*b* by way of nuts and bolts 209, valve ring 210, and cover lock 211. The suction valve 24 may be removed by removing the suction valve lock 211. Once the lock 211 is removed, the suction valve 24 may be pulled from the suction module 38*b*. This configuration allows removal of suction valve 24 from chamber 20*b*' through single opening 203, without removal of the suction module 38*b* or the fluid supply manifold 28.

Discharge valve 26, disposed in discharge section 40, includes valve seat 54 and a piston 80 for engaging valve seat 54. Piston 80 has a stem 82 that extends from a head 84 away from valve seat 54 and into a socket 86 in a discharge valve guide 88. At least one aperture 92 traverses guide 88 and intersects socket 86 to provide pressure relief to valve guide 88. A compressed spring 94 is disposed between valve guide 88 and head 84 for normally retaining head 84 in flush engagement with the top of valve seat 54 and keeping discharge valve 26 closed. Valve seat 54 rests on discharge deck 52. Discharge deck 52 forms a ledge of 90 degrees to allow for interchangeability with many existing valve seats. One could configure the deck to slope at an angle of approximately 30°. This slope would allow deck 52 to transfer forces impacted by valve seat 54 evenly to discharge section 40, thus reducing the likelihood of fatigue-induced cracks forming in housing 12. Valve guide 88 has a cover or closure portion formed integrally from annular flange 88' of valve guide 88. The cover portion 88' supports guide 88 and fills and seals an opening 300 which leads to hollow chamber 30*a* in which the discharge valve 26 is disposed. The cover portion 88' is retained in section 40 by way of nuts and bolts 214, valve ring 215 and cover lock 216. The discharge valve 26 may be removed by removing cover lock 216. Once the cover lock 216 is removed, the discharge valve 26 may be pulled from the chamber 30*a* through opening 300. This configuration allows removal of the discharge valve 26 through a single opening.

Should valves 24 and 26, ever require servicing, such are easy to repair or replace with ordinary tools and without major disassembly of fluid end assembly 10. The pistons and seals are the same size on both the suction and discharge side and are thus interchangeable.

Valves 24 and 26 permit fluid pressurized by the plunger (not shown) to move in only one direction from manifold 28 to outlet passage 30. Fluid moves by way of a reciprocating motion of the plunger in plunger bore 14, During the suction stroke of the plunger, fluid is drawn into plunger chamber 18 from suction passage 20*a*, 20*b*. During the pressure stroke of the plunger, fluid is pushed from the chamber 18 through discharge passage 22 and out port 30.

While the invention has been described with a high degree of particularity, it will be appreciated by those skilled in the art that modifications may be made thereto. Therefore, it is to be understood that the present invention is not limited to the sole embodiment described above, but encompasses any and all embodiments within the scope of the following claims.

The invention claimed is:

1. A fluid end assembly for a high pressure pump for receiving a fluid from a fluid supply manifold and supplying the fluid to an outlet manifold comprising:

a first section;

a plunger bore extending into said first section and oriented along a first centerline, said plunger bore configured for receiving a reciprocating plunger, a discharge section formed in said first section, said discharge section having a discharge passage and a valve chamber, said discharge passage intersecting said plunger bore, said discharge passage oriented along a second center line, said second centerline being coplanar with said first centerline and intersecting said first centerline at a first reference point to define a first obtuse angle $\lambda$;

a suction passage, said suction passage intersecting said plunger bore, said suction passage oriented along a third centerline, said third centerline being coplanar with said second centerline and first centerline and intersecting said first centerline at a second reference point so as to define a second obtuse angle $\alpha$;

a second section;

an inlet opening through a surface of said second section;

a suction port in said second section and a valve chamber in said second section, said valve chamber down stream of said suction inlet, said suction passage downstream of said suction port and said inlet;

wherein said second section is removably attached to said first section.

2. The fluid end assembly of claim 1 wherein the first section is removably attached to an outlet manifold.

3. The fluid end assembly of claim 1 wherein said first section valve chamber and said second section valve chamber each have a deck.

4. The fluid end assembly of claim 3 further comprising a suction valve in said second section valve chamber, said suction valve including a valve seat supported by said deck of said second section.

5. The fluid end assembly of claim 4, wherein said suction valve comprises: a piston having a head for releasably engaging said valve seat;

a stein extending away from said valve head;

a valve guide in said suction port, said valve guide having a socket configured to receive said stein and a plurality of apertures intersecting and extending from said socket wherein said apertures provide pressure relief to said socket; and a compressed spring disposed between said head and said valve guide, said compressed spring configured to maintain said head in contact with said valve seat.

6. The fluid end assembly of claim 5 further comprising a discharge valve in said discharge section valve chamber, said discharge valve including a valve seat supported by said deck of said discharge passage.

7. The fluid end assembly of claim 6 wherein said discharge valve comprises:

a piston having a head for releasably engaging said valve seat;

a stem extending away from said valve head;

a valve guide in said discharge passage adjacent the valve seat, said valve guide having a socket configured to receive said stem and a plurality of apertures intersecting and extending from said socket wherein said apertures provide pressure relief to said socket; and a compressed spring disposed between said head and said valve guide, said compressed spring configured to maintain said head in contact with said valve seat; and wherein the valve seats and pistons are interchangeable.

8. A section of a fluid end assembly, said section comprising:

a plunger bore extending into said first section and oriented along a first centerline, said plunger bore configured for receiving a reciprocating plunger, a discharge section formed in said first section, said discharge section having a discharge passage and a valve chamber, said discharge passage intersecting said plunger bore, said discharge passage oriented along a second centerline, said second centerline being coplanar with said first centerline and intersecting said first centerline at a first reference point to define a first obtuse angle $\lambda$;

a suction passage, said suction passage intersecting said plunger bore, said suction passage oriented along a third centerline, said third centerline being coplanar with said second centerline and first centerline and intersecting said first centerline at a second reference point so as to define a second obtuse angle $\alpha$ and wherein said section is a monobloc construction.

* * * * *